US005620343A

United States Patent [19]

Pan

[11] Patent Number: 5,620,343

[45] Date of Patent: Apr. 15, 1997

[54] WATERTIGHT SOCKET STRUCTURE FOR USE IN A LIGHT BULB

[76] Inventor: Wun F. Pan, No. 125, Lane 99, Pu Ting Road, Hsinchu, Taiwan

[21] Appl. No.: 603,420

[22] Filed: Feb. 20, 1996

[51] Int. Cl.[6] ..... H01R 17/00

[52] U.S. Cl. ..... 439/699.2; 439/619; 439/602

[58] Field of Search ..... 439/602, 619, 439/699.2, 280, 230

[56] References Cited

U.S. PATENT DOCUMENTS

| | | | |
|---|---|---|---|
| 4,199,212 | 4/1980 | Nakahara | 439/619 |
| 5,008,588 | 4/1991 | Baldyga | 439/602 |

FOREIGN PATENT DOCUMENTS

| | | | |
|---|---|---|---|
| 1603601 | 11/1981 | United Kingdom | 439/602 |
| 1603602 | 11/1981 | United Kingdom | 439/602 |

*Primary Examiner*—Neil Abrams
*Assistant Examiner*—Barry Matthew L. Standig
*Attorney, Agent, or Firm*—Morton J. Rosenberg; David I. Klein

[57] ABSTRACT

The present invention relates to a light bulb socket structure provided with sealing elements. The sealing elements, combined with conductor plates and electrical conductor wires, are arranged inside the body of the socket in such a way that the lower end of the socket is closed in a watertight manner. The inventive socket can prevent water or moisture from penetrating into the interior of the socket body and deteriorating the conductor parts of the socket.

1 Claim, 6 Drawing Sheets

WATERTIGHT SOCKET STRUCTURE FOR USE IN A LIGHT BULB

SUMMARY OF THE INVENTION

Decorative light bulb series is often used outdoors and thus it must be provided with a waterproofing feature to keep rain water or moisture from penetrating into the inside and deteriorating the conductor parts of the socket. However, in most cases, water or moisture would enter the socket not from the top because of a tight connection between the light bulb and the socket shell but through the opening that is formed on the bottom to allow electrical conductor wires passing through. Hence, the gaps between conductor wires and the socket walls constitute a main access for water or moisture. It is a major drawback of a conventional light bulb socket.

It is an object of the present invention to provide a watertight socket structure for use in a decorative light bulb series that is effectively and completely impervious to water, eliminating the drawback of a prior art bulb socket that water or moisture easily penetrates through the lower portion of the socket.

Now the present invention will be described in detail with reference to the accompanying drawings.

DETAILED DESCRIPTION OF A PREFERRED EMBODIMENT

Figure 1:
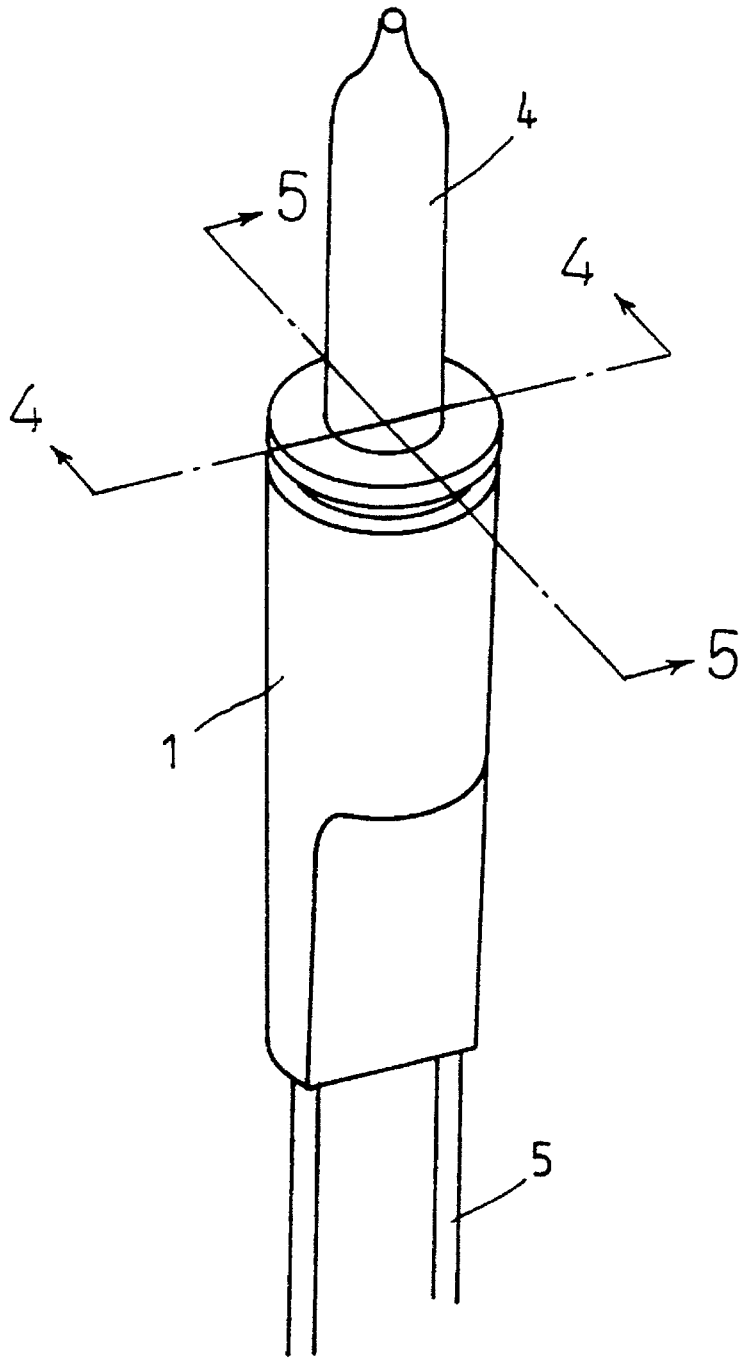
FIG. 1 perspectively shows a light bulb socket of the invention in an assembled state.
Figure 2:
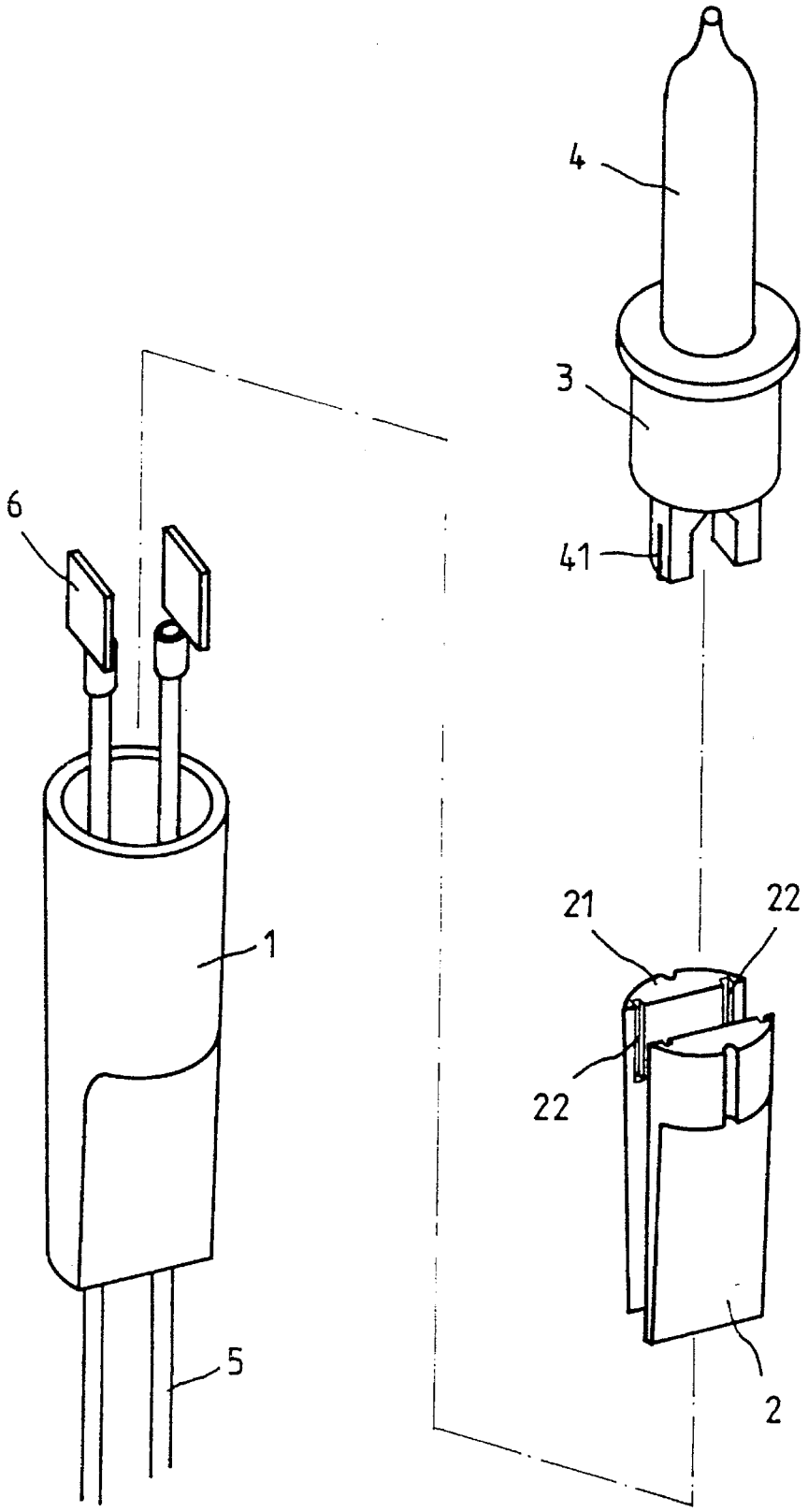
FIG. 2 is an exploded view of the light bulb socket of FIG. 1.
Figure 3:
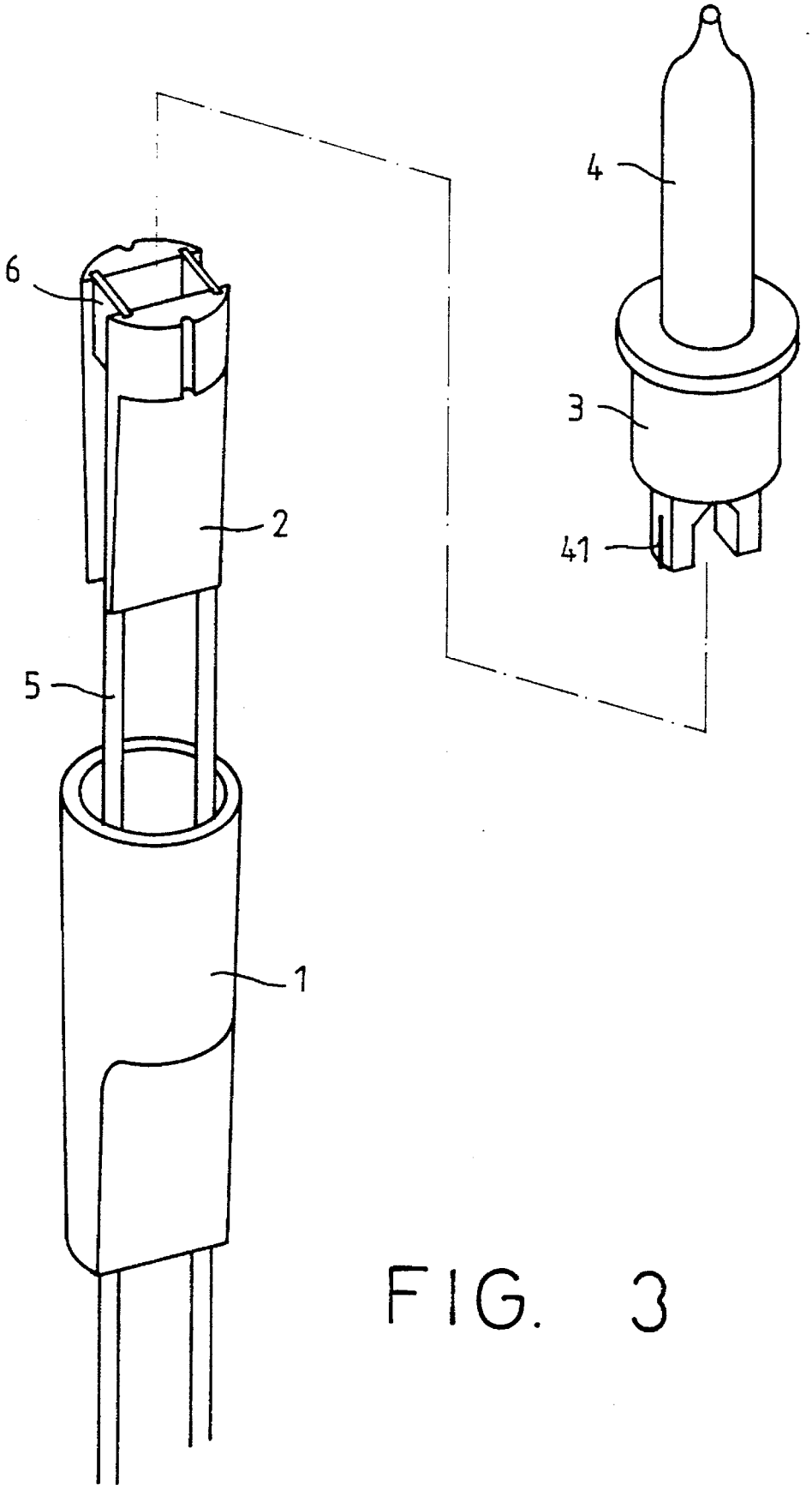
FIG. 3 is another exploded view of the light bulb socket of the invention.
Figure 4:
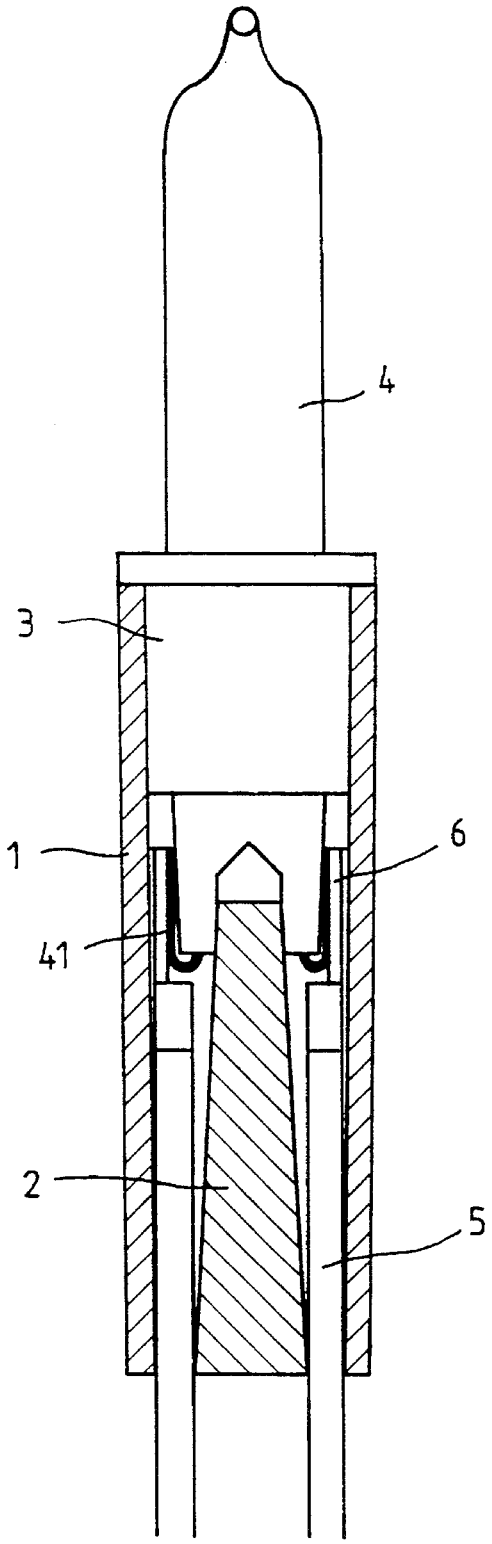
FIG. 4 is a cross sectional view taken along the line 4—4 of FIG. 1.
Figure 5:
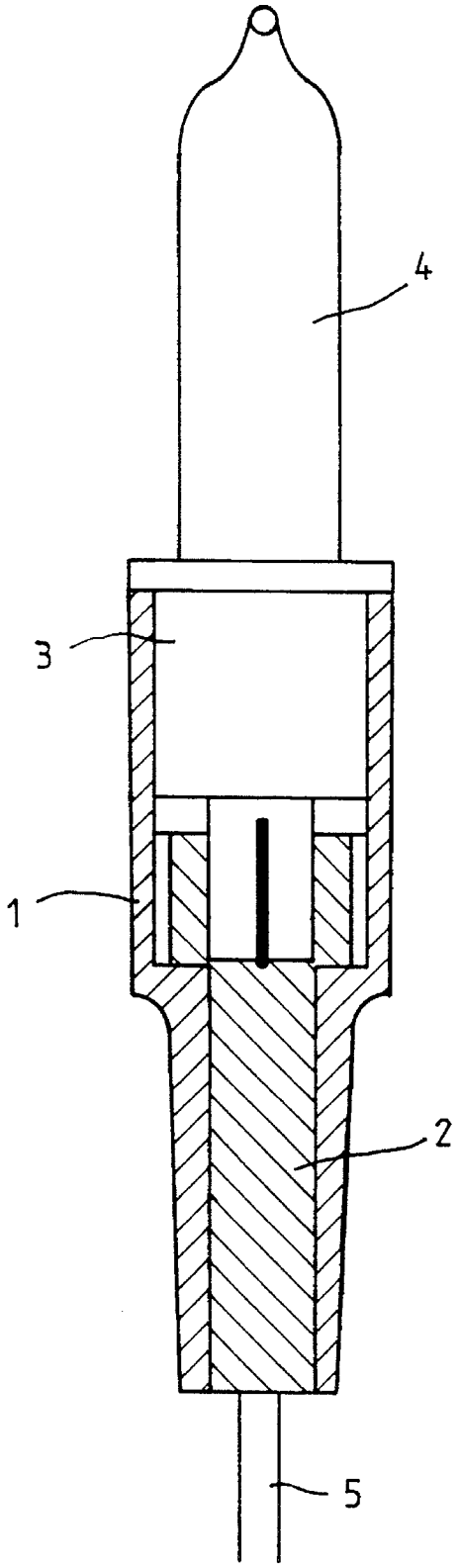
FIG. 5 is a cross sectional view taken along the line 5—5 of FIG. 1.
Figure 6:
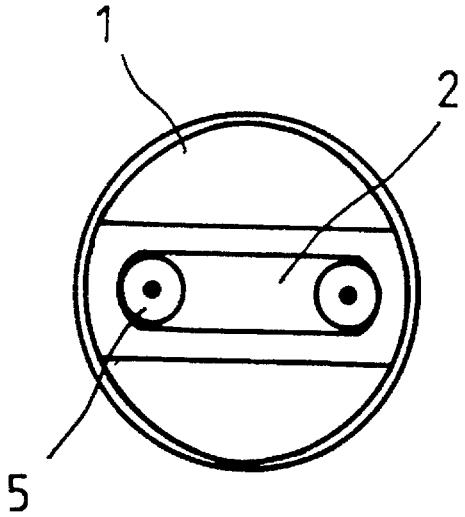
FIG. 6 is a bottom view of the light bulb socket of FIG. 1.

Referring to the drawings, the light bulb socket structure of the invention comprises a socket body (1), sealing elements (2), a light bulb holder (3), a light bulb (4), and two conductor plates (6) connected to electrical conductor wires (5). Similar to a conventional structure, the light bulb (4) is held in the holder (3) and the holder (3) is mounted on the top of the socket body (1). For these parts the inventive light bulb socket has the same structure with the same watertight features as a conventional socket. However, a socket according to the invention is further provided with sealing elements (2). Each sealing element is configured at its upper portion to have a semicylindrical body with two grooves (22) for securing conductor plates (6). The conductor plate (6) is electrically connected to lead wires (41) of the light bulb (4), which lead wires are routed under the holder (3). Electrical conductor wires (5) attached to the conductor plates (6) extend through another groove (23) formed on the cylindrical surface of the sealing element (2). With this arrangement a combination of sealing elements (2), conductor plates (6), and electrical conductor wires (5) is housed inside the socket body (1). As can be seen from FIGS. 4 and 6, the sealing elements (2) are snugly embraced by the outer walls of the socket body (1) and thus closes the opening on the bottom of the socket body (1) to ensure the waterproofness of the socket.

Therefore, the light bulb socket according to the invention can achieve a complete waterproofing effect even if it is used outdoors, preventing the penetration of water or moisture into the interior of the socket and the deterioration of electrical conductor parts.

What is claimed is:

1. A light bulb socket for use in a decorative light bulb series, comprising a light bulb held in a holder, a light bulb holder mounted on the top of a socket body, conductor plates connected to electrical conductor wires and housed inside the socket body to electrically connected with lead wires of the light bulb, and electrical conductor wires extending through the bottom of the socket body and characterized in that inside said socket body there is provided with two sealing elements that respectively have a semicylindrical configuration at the upper portion thereof with two grooves formed on the side surface facing each other to secure said conductor plates and a groove formed on the semicylindrical surface to allow the lead wires of said light bulb passing through, said sealing elements being so snugly fitted into said socket body that the bottom of the socket body is closed in a watertight manner.

* * * * *